US006120139A

United States Patent [19]

Childers et al.

[11] Patent Number: 6,120,139

[45] **Date of Patent: *Sep. 19, 2000**

[54] INK FLOW DESIGN TO PROVIDE INCREASED HEAT REMOVAL FROM AN INKJET PRINTHEAD AND TO PROVIDE FOR AIR ACCUMULATION

[75] Inventors: Winthrop Childers, San Diego; John Wade, Poway; Joe R. Pietrzyk, San Diego, all of Calif.

[73] Assignee: Hewlett-Packard Company, Palo Alto, Calif.

[ * ] Notice: This patent is subject to a terminal disclaimer.

[21] Appl. No.: 09/071,141

[22] Filed: Apr. 30, 1998

Related U.S. Application Data

[63] Continuation-in-part of application No. 08/748,726, Nov. 13, 1996, Pat. No. 5,815,185.

[51] Int. Cl.[7] ..... B41J 2/19

[52] U.S. Cl. ..... 347/92

[58] Field of Search ..... 347/92, 85, 86

[56] References Cited

U.S. PATENT DOCUMENTS

| | | | |
|---|---|---|---|
| 4,015,272 | 3/1977 | Yamamori et al. | 347/68 |
| 5,278,584 | 1/1994 | Keefe et al. | 347/63 |
| 5,815,185 | 9/1998 | Pietrzyk | 347/92 |

*Primary Examiner*—N. Le
*Assistant Examiner*—Michael Nghiem
*Attorney, Agent, or Firm*—Dennis G. Stenstrom

[57] ABSTRACT

Disclosed is a printing device that overcomes the thermal problems of previous printheads caused by heat generation by providing better cooling of the printhead,avoids bubble accumulation near the printhead which can starve the printhead of ink and provides sufficient volume for air accumulation away from the printhead. The printing device including an outer housing, a substrate having a front surface on which is formed ink ejection chambers and having a back surface, an ink conduit having a distal end proximate to the back surface of the substrate, the ink conduit, the outer housing and the substrate defining an ink flow path to the ink ejection chambers and a bubble accumulation chamber in communication with the ink flow path such that bouyancy will tend to move bubbles that accumulate in the ink flow path into the bubble accumulation chamber.

24 Claims, 12 Drawing Sheets

INK FLOW DESIGN TO PROVIDE INCREASED HEAT REMOVAL FROM AN INKJET PRINTHEAD AND TO PROVIDE FOR AIR ACCUMULATION

CROSS-REFERENCE TO RELATED APPLICATIONS

This application is a continuation-in-part of U.S. appln No. 08/748,726 filed Nov. 13, 1996 now U.S. Pat. No. 5,815,185 entitled "Ink Flow Heat Exchanger for Inkjet Printhead." This application is related to U.S. patent application Ser. No. 08/962,031, filed Oct. 31, 1997, entitled "Ink Delivery System for High Speed Printing," U.S. patent application Ser. No. 08/846,970, filed Apr. 30, 1997, entitled "Ink Delivery System That Utilizes a Separate Insertable Filter Carrier" and U.S. patent application Ser. No. 08/706,121, U.S. Pat. No. 5,966,155 filed Aug. 30, 1996, entitled "Inkjet Printing System with Off-Axis Ink Supply Having Ink Path Which Does Not Extend above Print Cartridge." The foregoing commonly assigned patent applications are herein incorporated by reference.

FIELD OF THE INVENTION

This invention relates to inkjet printers and, more particularly, to an inkjet printer having a scanning printhead with an ink delivery system is provided that utilizes a filter carrier to simplify the process of attaching the filter.

BACKGROUND OF THE INVENTION

Thermal inkjet hardcopy devices such as printers, graphics plotters, facsimile machines and copiers have gained wide acceptance. These hardcopy devices are described by W. J. Lloyd and H. T. Taub in "Ink Jet Devices," Chapter 13 of *Output Hardcopy Devices* (Ed. R. C. Durbeck and S. Sherr, San Diego: Academic Press, 1988) and U.S. Pat. Nos. 4,490,728 and 4,313,684. The basics of this technology are further disclosed in various articles in several editions of the *Hewlett-Packard Journal* [Vol. 36, No. 5 (May 1985), Vol. 39, No. 4 (August 1988), Vol. 39, No. 5 (October 1988), Vol. 43, No. 4 (August 1992), Vol. 43, No. 6 (December 1992) and Vol. 45, No. 1 (February 1994)], incorporated herein by reference. Inkjet hardcopy devices produce high quality print, are compact and portable, and print quickly and quietly because only ink strikes the paper.

An inkjet printer forms a printed image by printing a pattern of individual dots at particular locations of an array defined for the printing medium. The locations are conveniently visualized as being small dots in a rectilinear array. The locations are sometimes "dot locations", "dot positions", or pixels". Thus, the printing operation can be viewed as the filling of a pattern of dot locations with dots of ink.

Inkjet hardcopy devices print dots by ejecting very small drops of ink onto the print medium and typically include a movable carriage that supports one or more printheads each having ink ejecting nozzles. The carriage traverses over the surface of the print medium, and the nozzles are controlled to eject drops of ink at appropriate times pursuant to command of a microcomputer or other controller, wherein the timing of the application of the ink drops is intended to correspond to the pattern of pixels of the image being printed.

The typical inkjet printhead (i.e., the silicon substrate, structures built on the substrate, and connections to the substrate) uses liquid ink (i.e., dissolved colorants or pigments dispersed in a solvent). It has an array of precisely formed orifices or nozzles attached to a printhead substrate that incorporates an array of ink ejection chambers which receive liquid ink from the ink reservoir. Each chamber is located opposite the nozzle so ink can collect between it and the nozzle. The ejection of ink droplets is typically under the control of a microprocessor, the signals of which are conveyed by electrical traces to the resistor elements. When electric printing pulses heat the inkjet firing chamber resistor, a small portion of the ink next to it vaporizes and ejects a drop of ink from the printhead. Properly arranged nozzles form a dot matrix pattern. Properly sequencing the operation of each nozzle causes characters or images to be printed upon the paper as the printhead moves past the paper.

The ink cartridge containing the nozzles is moved repeatedly across the width of the medium to be printed upon. At each of a designated number of increments of this movement across the medium, each of the nozzles is caused either to eject ink or to refrain from ejecting ink according to the program output of the controlling microprocessor. Each completed movement across the medium can print a swath approximately as wide as the number of nozzles arranged in a column of the ink cartridge multiplied times the distance between nozzle centers. After each such completed movement or swath the medium is moved forward the width of the swath, and the ink cartridge begins the next swath. By proper selection and timing of the signals, the desired print is obtained on the medium.

Inkjet printheads are typically attached to a housing or body of a print cartridge. The inkjet printhead ink is fed from an internal ink reservoir integral to the print cartridge or from an "off-axis" ink supply which feeds ink to the print cartridge via tubes connecting the print cartridge and ink supply. A print cartridge having an "off-axis" ink supply usually also has a very small internal ink reservoir. In either case, the housing has an ink conduit for supplying ink from an the internal ink reservoir to the printhead. Ink is then fed to the various vaporization chambers either through an elongated hole formed in the center of the bottom of the substrate, "center feed", or around the outer edges of the substrate, "edge feed". In center feed the ink then flows through a central slot in the substrate into a central manifold area formed in a barrier layer between the substrate and a nozzle member, then into a plurality of ink inlet channels, and finally into the various ink vaporization chambers. In edge feed ink from the ink reservoir flows around the outer edges of the substrate into the ink inlet channels and finally into the ink vaporization chambers. Inkjet printheads are very sensitive to particulate contamination. To deal with this problem, a filter is typically disposed in the ink fluid path between the reservoir of ink and the printhead.

In either center feed or edge feed, the flow path from the ink reservoir to the printhead inherently provides restrictions on ink flow to the ink vaporization chambers. A concern with inkjet printing is the sufficiency of ink flow to the paper or other print media. Print quality is a function of ink flow through the printhead. Too little ink on the paper or other media to be printed upon produces faded and hard-to-read documents.

To increase resolution and print quality, the printhead nozzles must be placed closer together. This requires that both heater resistors and the associated vaporization chambers be placed closer together. To increase printer throughput, the width of the printing swath is increased by placing a larger number of nozzles on the printhead. Also, printer throughput is increased by firing the heater resistors at a higher frequency. An increased number of heater resistors spaced closer together and firing at a higher frequency creates a much greater concentration of heat generation. It is necessary to remove this heat from the printhead to prevent difficulty in supplying ink to each vaporization chamber quickly.

Previous printheads when operating at a high ink ejection rates have had cooling problems because the flow of ink across the back surface of the printhead is insufficient to adequately cool the printhead. When the temperature of the printhead gets too high print quality is degraded. This is because the printhead is finely tuned to operate optimally within a narrow temperature range because ink properties and the characteristics of bubble nucleation and growth are strongly dependent on temperature and the printhead does not perform well outside this temperature range.

Air and other gas bubbles and particulate matter can also cause major problems in ink delivery systems. Ink delivery systems are capable of releasing gasses and generating bubbles, thereby causing systems to get clogged and degraded by bubbles. In the design of a good ink delivery system, it is important that techniques for eliminating or reducing bubble problems be considered. Therefore, another problem that occurs during the life of the print element is air out-gassing. Air builds up between the filter and the printhead during operation of the printhead. For printers that have a high use model, it would be preferable to have a larger volume between the filter and the printhead for the storage of air. For low use rate printers, this volume would be reduced.

There is a need for high speed printing devices, such as desktop printers, large format printers, facsimile machines and copiers. In the past, printheads have not had the ability to operate at high speed ink ejection rates required for high speed printing rates due to lack of the ability to remove the large amount of heat generated.

Accordingly, there is a need for a new ink flow design for an ink delivery system operating at high speed printing rates.

SUMMARY OF THE INVENTION

The present invention is an printing device that overcomes the thermal problems of previous printheads caused by heat generation by providing better cooling of the printhead avoids bubble accumulation near the printhead which can starve the printhead of ink and provides sufficient volume for air accumulation away from the printhead. The printing device including an outer housing, a substrate having a front surface on which is formed ink ejection chambers and having a back surface, an ink conduit having a distal end proximate to the back surface of the substrate, the ink conduit, the outer housing and the substrate defining an ink flow path to the ink ejection chambers and a bubble accumulation chamber in communication with the ink flow path such that buoyancy will tend to move bubbles that accumulate in the ink flow path into the bubble accumulation chamber.

DETAILED DESCRIPTION OF THE PREFERRED EMBODIMENTS

Figure 1:
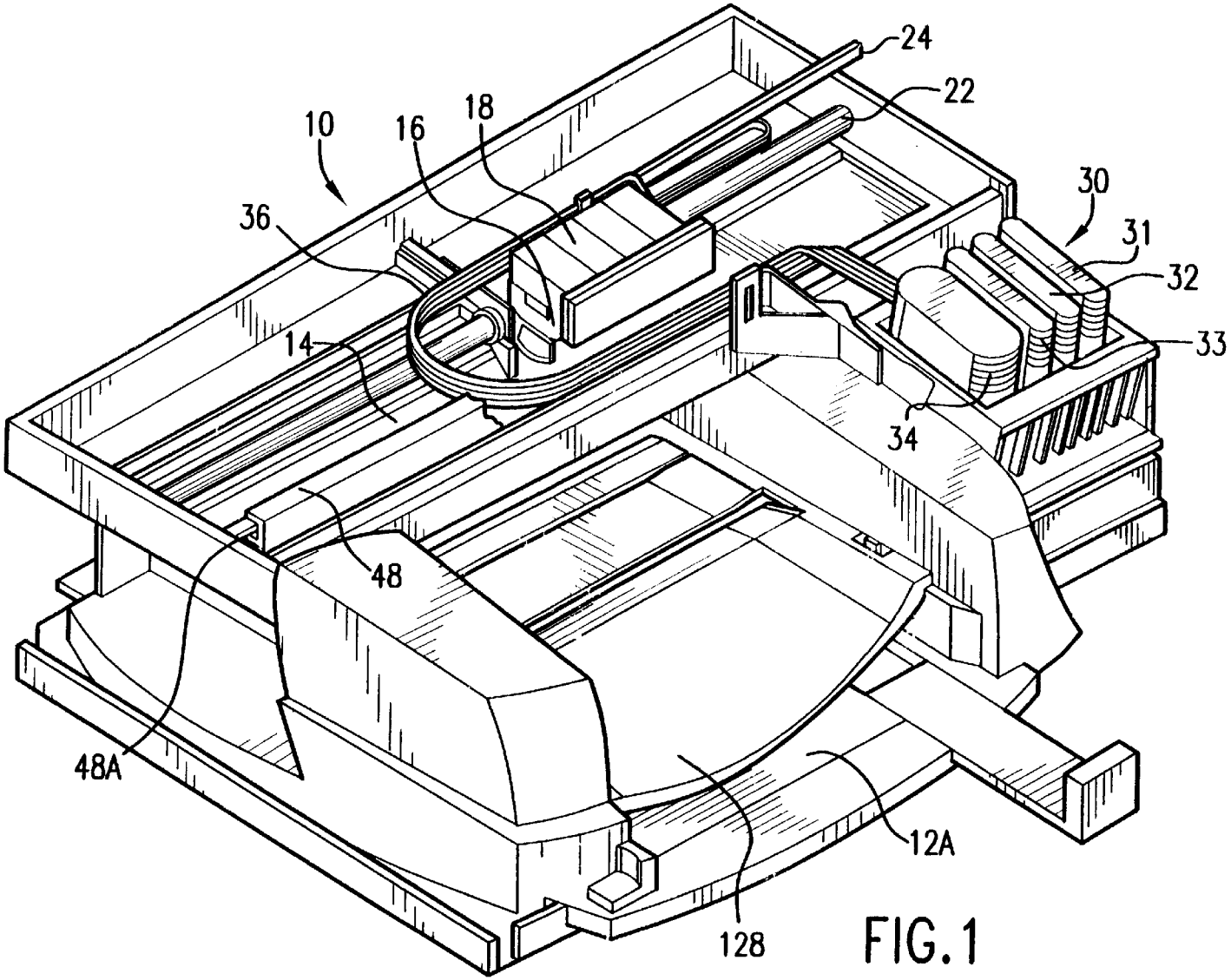
FIG. 1 is a perspective view of one embodiment of an inkjet printer incorporating the present invention.

While the present invention will be described below in the context of an off-axis printer having an external ink source, it should be apparent that the present invention is equally useful in an inkjet printer which uses on-axis inkjet print cartridges having an ink reservoir integral with the print cartridge. FIG. 1 is a perspective view of one embodiment of an inkjet printer 10, with its cover removed, suitable for utilizing the present invention. Generally, printer 10 includes a tray 12A for holding virgin paper. When a printing operation is initiated, a sheet of paper from tray 12A is fed into printer 10 using a sheet feeder, then brought around in a U direction to now travel in the opposite direction toward tray 12B. The sheet is stopped in a print zone 14, and a scanning carriage 16, supporting one or more print cartridges 18, is then scanned across the sheet for printing a swath of ink thereon. After a single scan or multiple scans, the sheet is then incrementally shifted using a conventional stepper motor and feed rollers to a next position within the print zone 14, and carriage 16 again scans across the sheet for printing a next swath of ink. When the printing on the sheet is complete, the sheet is forwarded to a position above tray 12B, held in that position to ensure the ink is dry, and then released.

The carriage 16 scanning mechanism may generally include a slide rod 22, along which carriage 16 slides and a flexible electrical cable (not shown) which transmits electrical signals from the printer's microprocessor to electrical contacts on the carriage 16. Also shown is a coded strip 24 which is optically detected by a photo detector on carriage 16 for precisely spatially positioning carriage 16. A motor (not shown), connected to carriage 16 is used for transporting carriage 16 along slide rod 22 across print zone 14.

The features of inkjet printer 10 also include an ink delivery system for providing ink to the print cartridges 18 and ultimately to the ink ejection chambers in the printheads from an off-axis ink supply station 30 containing replaceable ink supply cartridges 31, 32, 33, and 34, which may be pressurized or at atmospheric pressure. For color printers, there will typically be a separate ink supply cartridge for black ink, yellow ink, magenta ink, and cyan ink. Four tubes 36 carry ink from the four replaceable ink supply cartridges 31–34 to the print cartridges 18.

Figure 2:
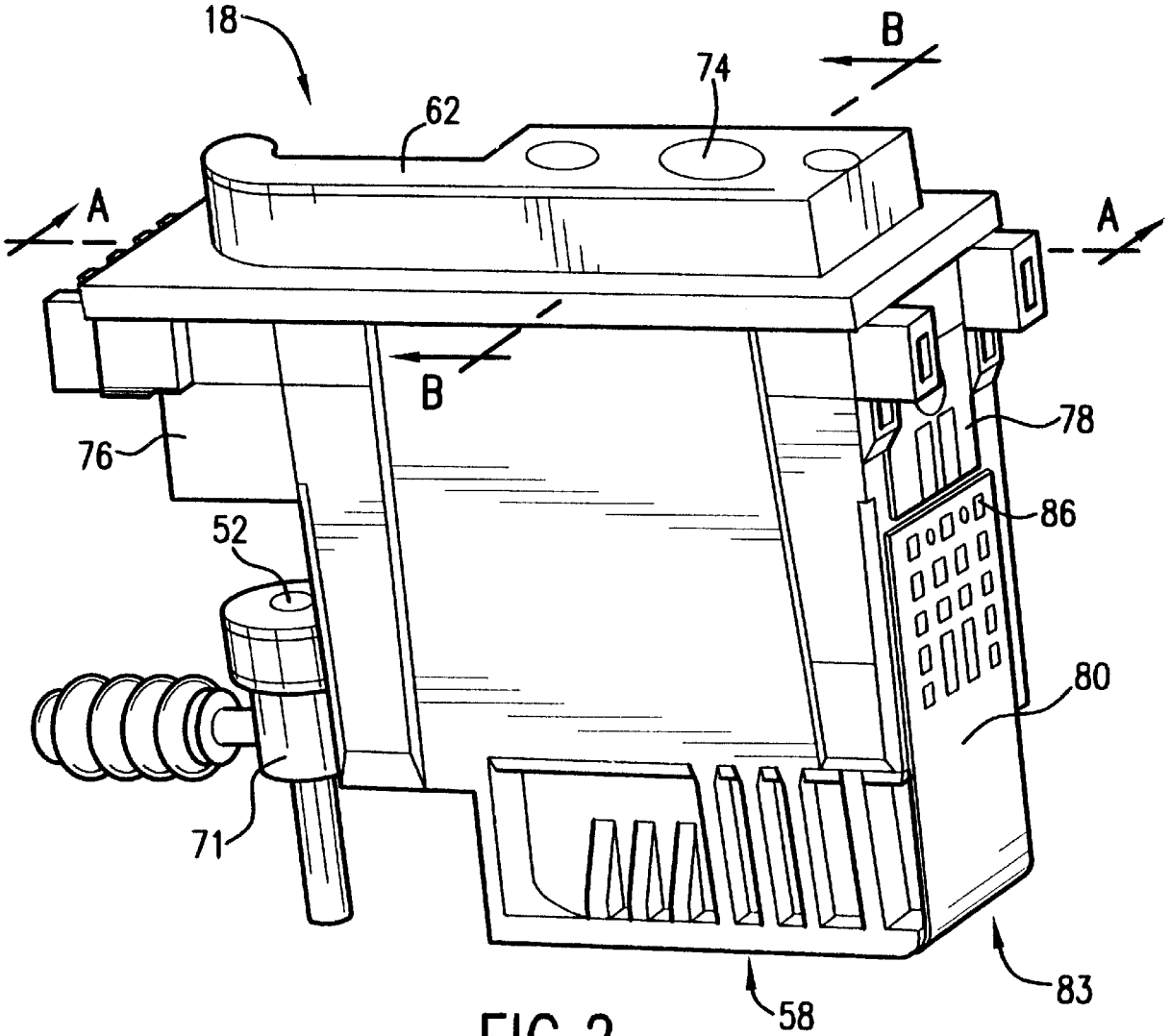
FIG. 2 is a perspective view of a single print cartridge showing the flexible electric circuit and its electrical contact pads and also showing the fluid interconnect to the carriage.

FIG. 2 is a perspective view of one embodiment of a print cartridge 18. The printhead nozzle array is at location 58. An integrated circuit chip 78 provides feedback to the printer regarding certain parameters of print cartridge 18. A flexible electrical tape circuit 80 contains electrical contact pads 86, electrical leads 84 (shown in FIG. 5) and nozzles 82 (shown in FIG. 3) laser ablated through tape 80. The flexible electrical tape circuit 80 is affixed to the printhead substrate 88 and to the barrier layer 104 to form a printhead assembly 83. Printhead assembly 83 is then secured to print cartridge 18 as described below with respect to FIG. 7. The contact pads 86 align with and engage electrical contacts (not shown) on carriage 16 when the print cartridge 18 is installed in carriage 16. Preferably, the electrical contacts on carriage 16 are resiliently biased toward print cartridge 18 to ensure a reliable contact.

A septum elbow 71 routes ink from the carriage 16 to the septum 52 and supports the septum. An air vent 74 formed in the top of print cartridge 18 is used by a pressure regulator located in print cartridge 18 and described below. In an alternative embodiment, a separate regulator may be connected between the off-axis ink supply and each print cartridge 18. When the print cartridges 18 are installed in carriage 16, the print cartridges 18 are in fluid communication with an off-carriage ink supply 31–34 that is releasably mounted in ink supply station 30.

Figure 3:
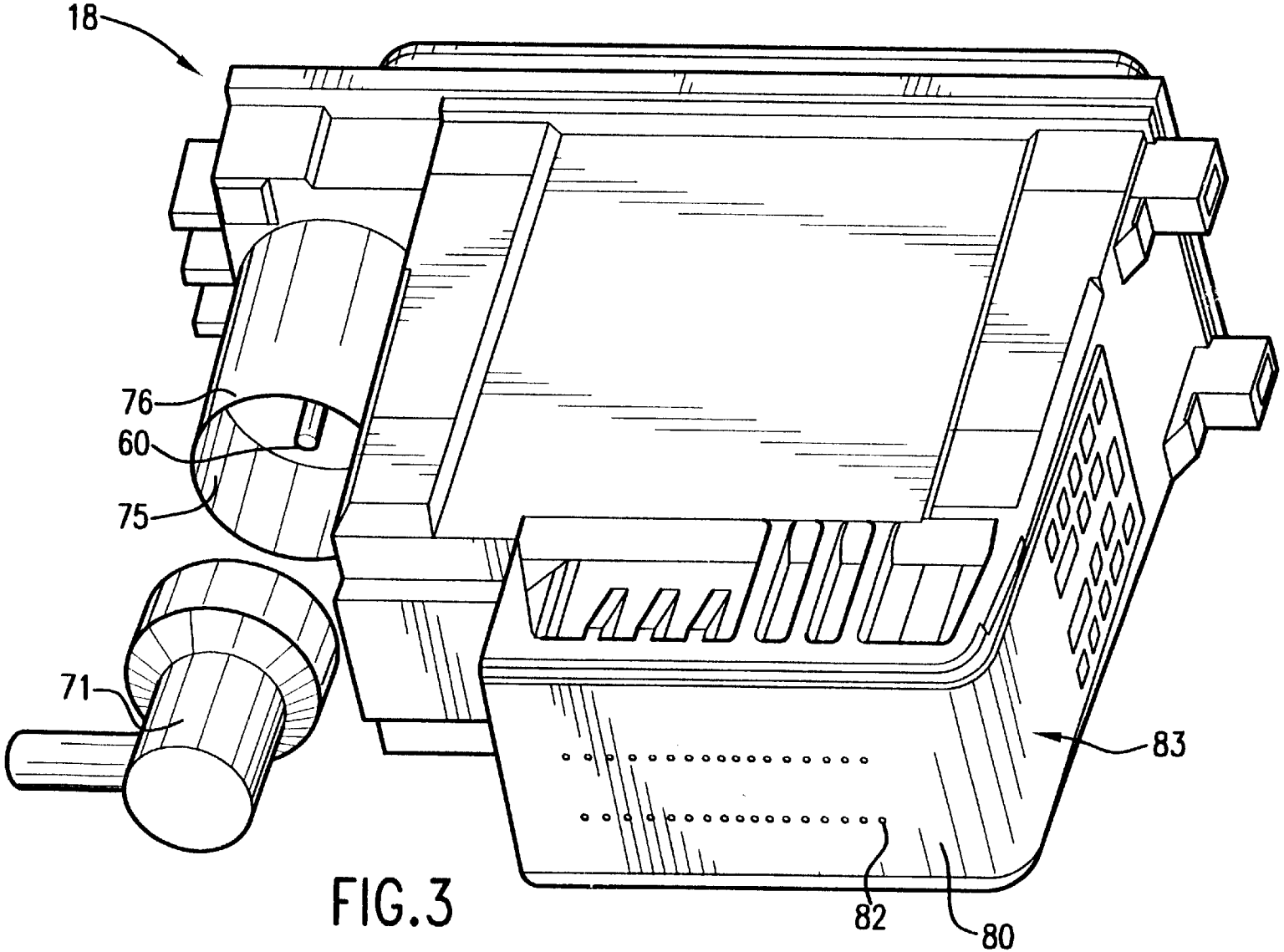
FIG. 3 is another perspective view of a single print cartridge showing the printhead portion on the bottom surface of the cartridge and the fluid interconnect to the carriage.

FIG. 3 illustrates the bottom side of print cartridge 18. Two parallel rows of offset nozzles 82 are laser ablated through tape 80.

Figure 4:
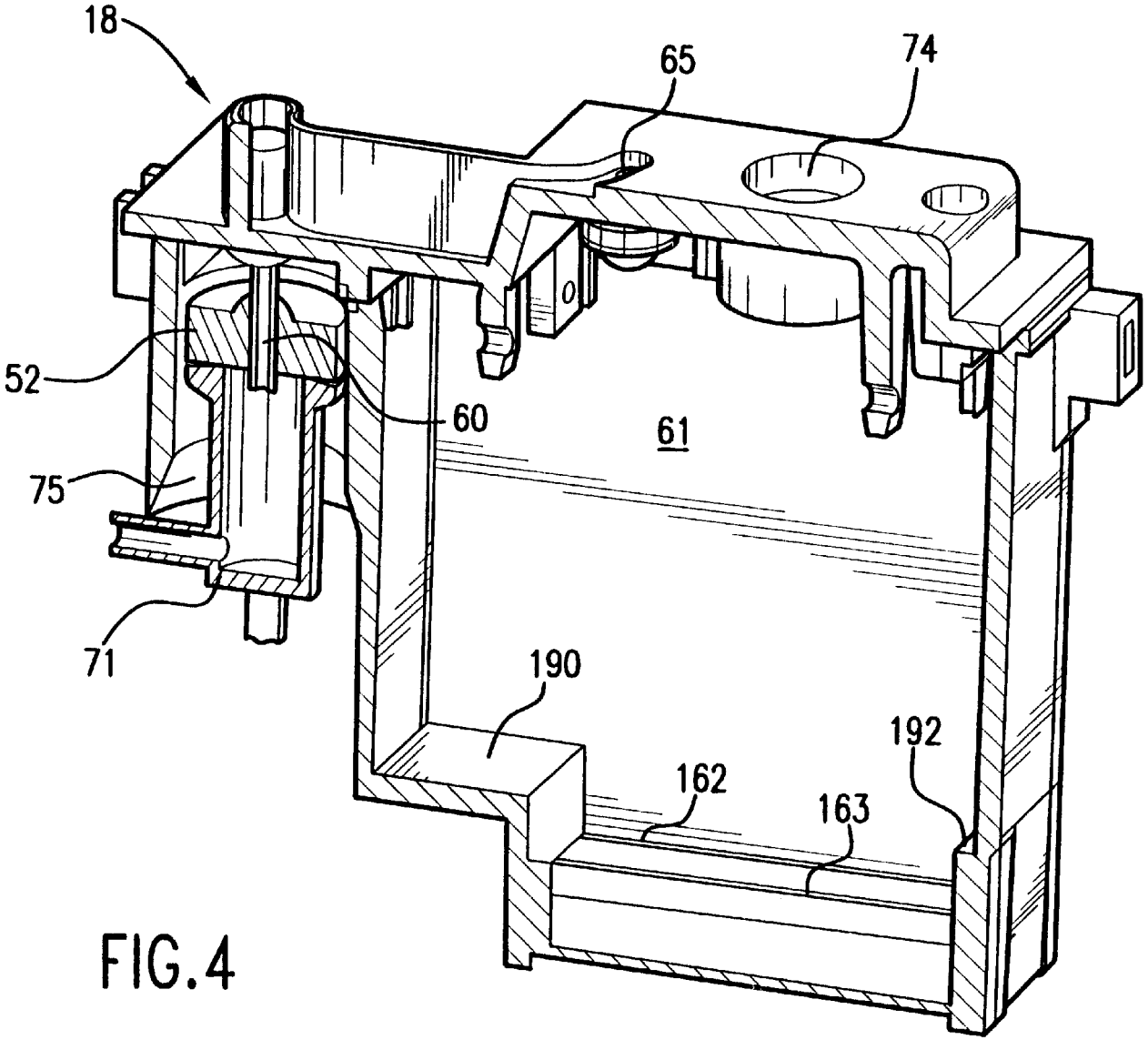
FIG. 4 is a cross-sectional, perspective view along line A—A of the print cartridge of FIG. 2 showing the print cartridge connected to the fluid interconnect on the carriage.

FIG. 4 is a cross-sectional perspective view of print cartridge 18, with tape 80 removed, taken along line A—A in FIG. 2. A shroud 76 surrounds the hollow needle 60 to prevent inadvertent contact with needle 60 and also to help align septum 52 with needle 60 when installing print cartridge 18 in carriage 16. Shroud 76 is shown having an inner conical or tapered portion 75 to receive septum 52 and center septum 52 with respect to needle 60. A plastic conduit 62 leads from the needle 60 to chamber 61 via hole 65.

Embodiments of scanning carriages and print cartridges are described in U.S. patent application Ser. No. 08/706,121, now U.S. Pat. No. 5,996,155 filed Aug. 30, 1996, entitled "Inkjet Printing System with Off-Axis ink Supply Having ink Path Which Does Not Extend above Print Cartridge," which is herein incorporated by reference.

A regulator valve (not shown) within print cartridge 18 regulates pressure by opening and closing an inlet hole 65 to an internal ink chamber 61 of print cartridge 18. When the regulator valve is opened, the hollow needle 60 is in fluid communication with an ink chamber 61 internal to the cartridge 18. The needle 60 extends through a self-sealing hole formed in through the center of the septum 52. The hole is automatically sealed by the resiliency of the rubber septum 52 when the needle is removed.

For a description of the design and operation of the regulator see U.S. patent application Ser. No. 08/706,121, now U.S. Pat. No. 5,966,155 filed Aug. 30, 1996, entitled "Inkjet Printing System with Off-Axis Ink Supply Having Ink Path Which Does Not Extend above Print Cartridge," which is herein incorporated by reference.

Figure 5:
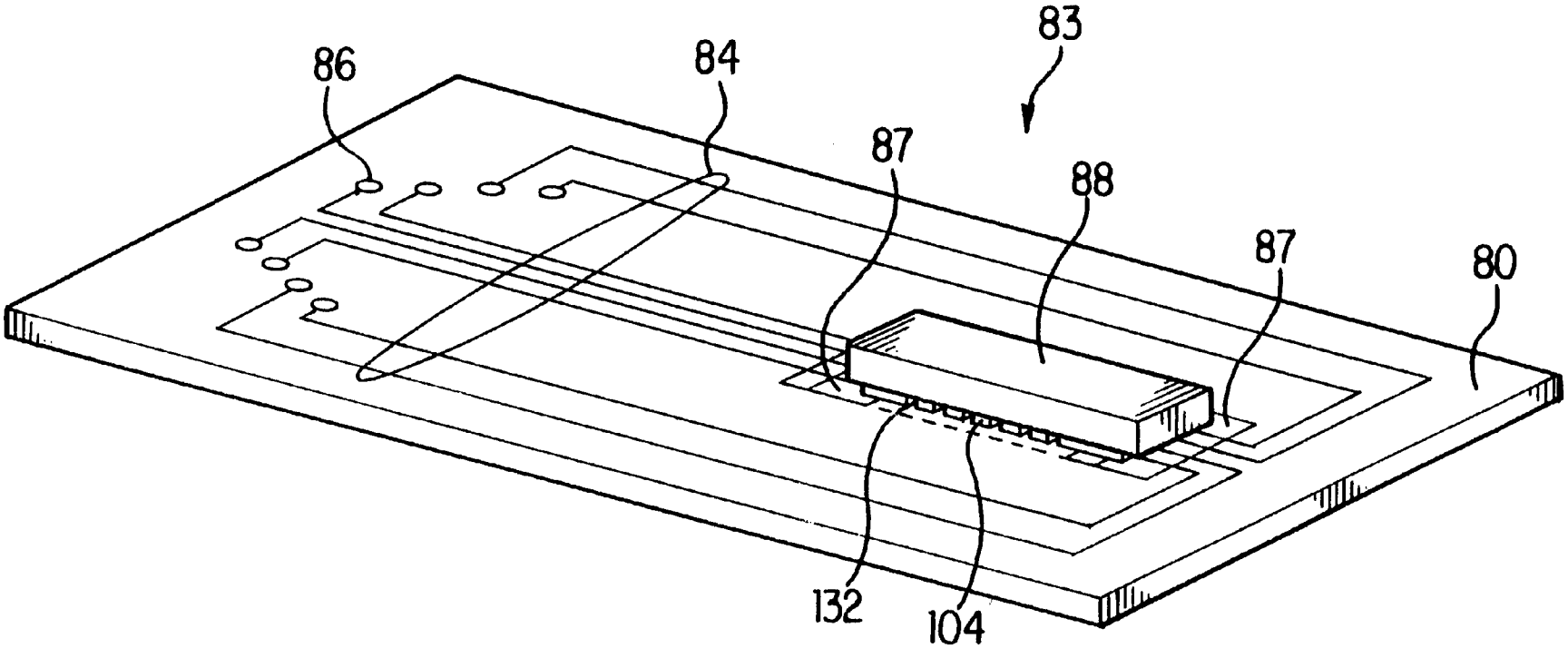
FIG. 5 is a simplified perspective view of the back side of the printhead assembly.

FIG. 5 shows a simplified schematic of the printhead assembly 83 shown in FIGS. 2 and 3. Electrical leads 84 are formed on the back of tape 80 and terminate in contact pads 86 for engaging electrical contacts on carriage 16. The other ends of electrical leads 84 are bonded through windows 87 to terminals of a substrate 88 on which are formed the various ink ejection chambers and ink ejection elements. The ink ejection elements may be heater resistors or piezoelectric elements.

A demultiplexer on substrate 88 demultiplexes the incoming electrical signals applied to contact pads 86 and selectively energizes the various ink ejection elements to eject droplets of ink from nozzles 82 as printhead 83 scans across the print zone. In one embodiment, the dots per inch (dpi) resolution is 600 dpi, and there are 512 nozzles 82.

Figure 6:
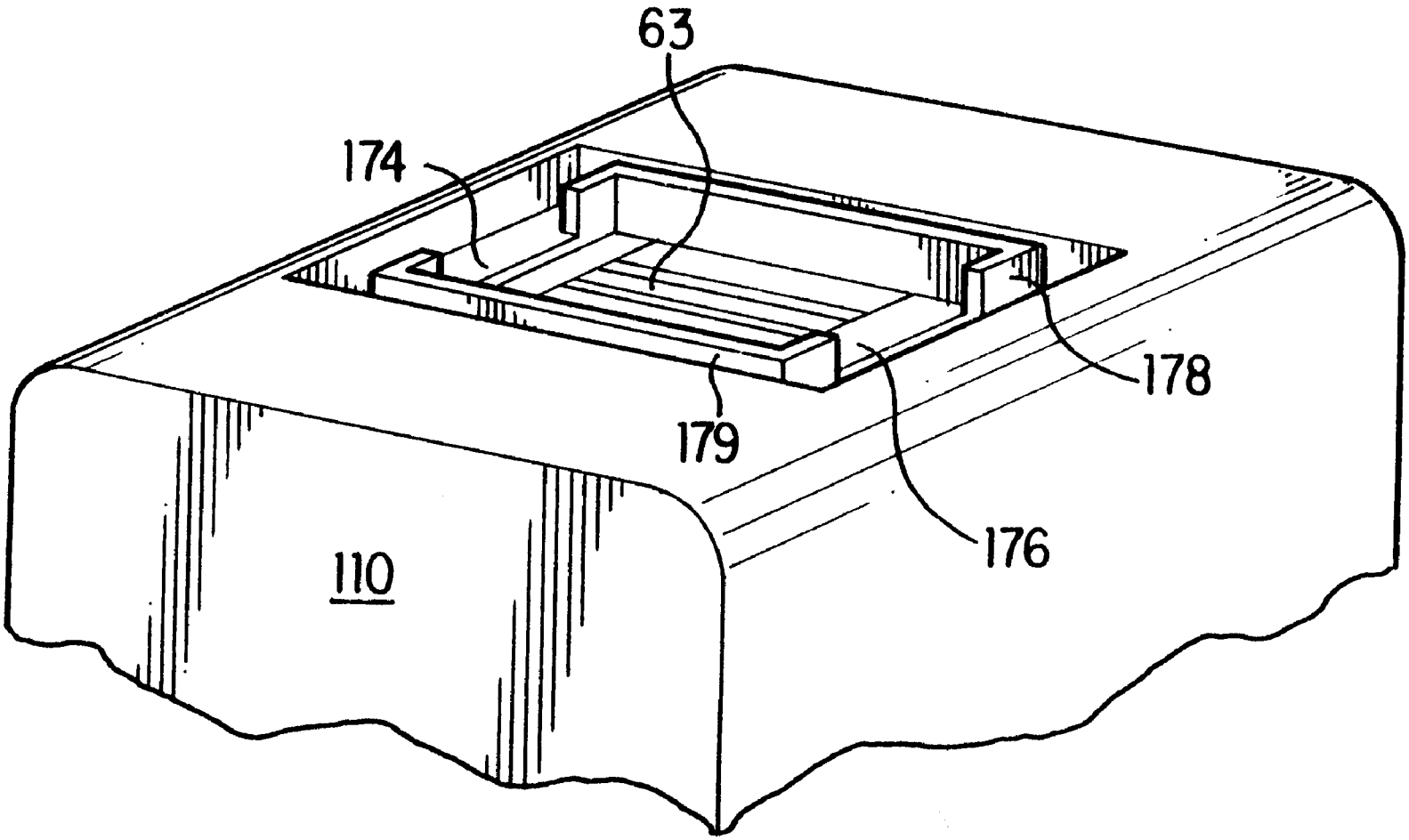
FIG. 6 is a perspective view the of print cartridge of FIG. 2 showing the headland area where the substrate and flex tape is attached.

FIG. 6 is perspective view of the print cartridge 18 with the printhead assembly 83 removed. An adhesive/sealant is applied to headland areas 174 and 176 and along the top of headland walls 178 and 179 to secure the printhead assembly 83 to the print cartridge body 110. The adhesive/sealant at areas 174 and 176 squishes upward to secure the ends of the substrate 88 to the print cartridge body 110 and insulates the electrical leads 84 on the back of tape 80 so they will not be shorted by ink in the vicinity of the electrical leads 84.

Figure 7:
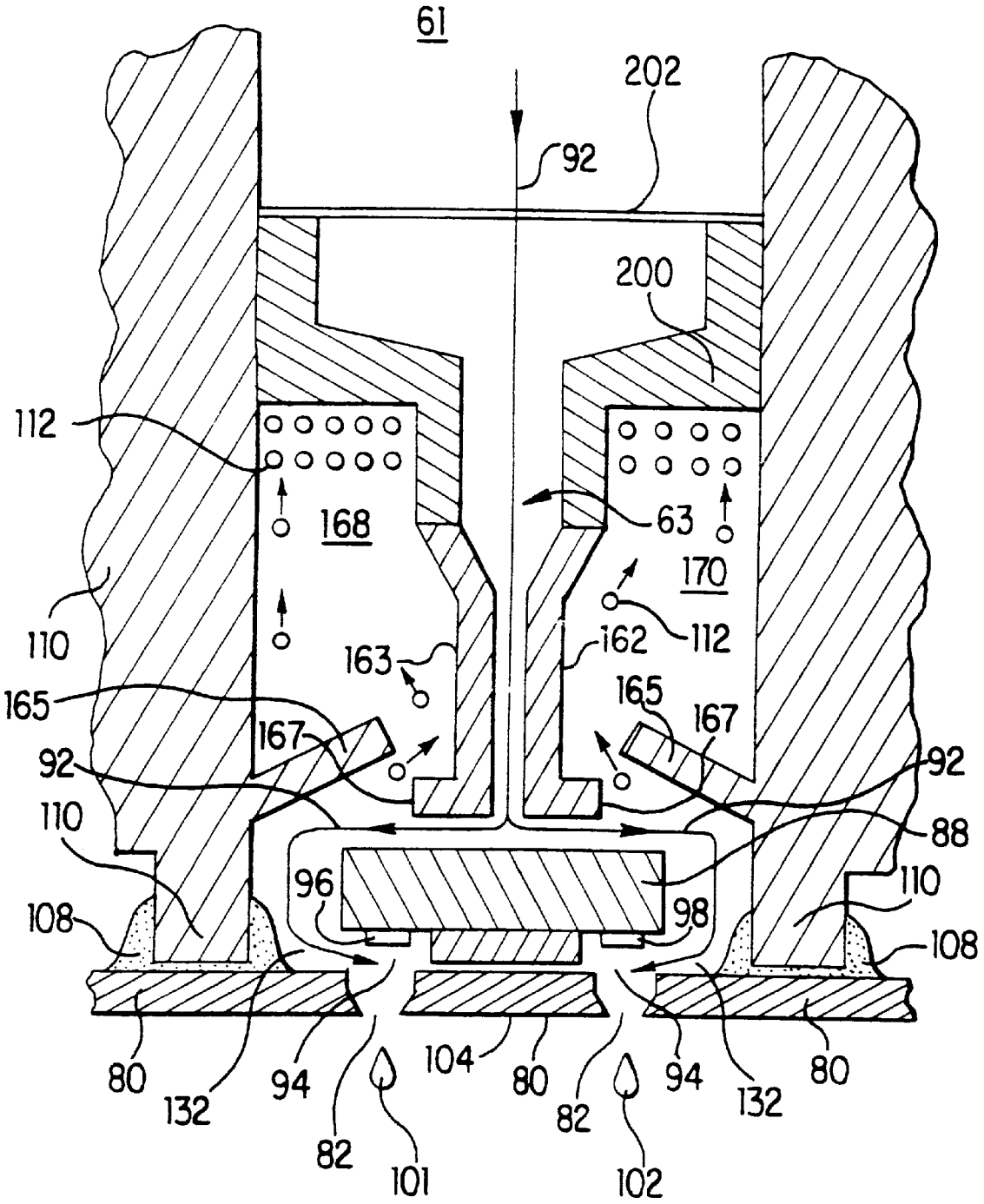
FIG. 7 is a cross-sectional view along line B—B of FIG. 2 showing the flow of ink to the ink ejection chambers in an edge feed printhead using an embodiment of the present invention.

FIG. 7 is a cross-sectional view along line B—B of FIG. 2 showing the flow of ink 92 from the ink chamber 61 within print cartridge 18 to ink ejection chambers 94 in an edge feed printhead using one embodiment of the present invention. Elements identified with the same numerals as in other figures may be identical and will not be redundantly described.

The barrier layer 104, the flexible tape 80 and substrate 88 define the ink inlet channels 132 and ink vaporization chambers 94. Energization of the ink ejection elements 96 and 98 cause a droplet of ink 101, 102 to be ejected through the nozzles 82 associated with the ink ejection chambers 94. The conductor portion of the flexible tape 80 is glued with adhesive 108 to the plastic print cartridge body 110. For a description of the barrier layer defining the ink inlet channels 132, the ink vaporization chambers 94, the heater resistors 96, 98 within the ink vaporization chambers 94 and the electrical circuitry of the printhead, see U.S. patent application Ser. No. 08/962,031, filed Oct. 31, 1997, entitled "Ink Delivery System for High Speed Printing;"

The plastic body 110 of print cartridge 18 is formed such that the ink conduit 63 directs the flow of ink 92 from ink chamber 61 within the print cartridge 18 towards the back of the substrate 88. Ink conduit 63 is defined by the walls of filter carrier 200, ink conduit walls 162, 163 and the walls of cartridge body 110. walls 162 and 163 are substantially aligned in a direction perpendicular to the back surface of substrate 88. conduit 63 includes a distal end that is proximate to the back surface of substrate 88. The ink conduit 63 includes section comprising a narrow ink feed slot that communicates with a back surface of substrate 88. The ink feed slot defines a distal conduit opening that is adjacent to the back surface of substrate 88.

Ink conduit walls 162, 163 become closer together near substrate 88 to increase the velocity of the ink that impinges on the back of substrate 88. The distance between ink conduit walls 162, 163 may be between about 0.5 mm and 5 mm. In a preferred embodiment, the distal end of conduit 63 extends to within a distance between 3 and 12 mils of the back surface of substrate 88. The distance, in the preferred embodiment, between walls 162, 163 is approximately 1 mm. Other distances may also be suitable depending upon the size of substrate 88, ink viscosity, and ink flow rates. The distal end includes laterally extending portions 167. In a preferred embodiment, the laterally extending portions are directed parallel to the back surface of substrate 88. Laterally extending flow directors 165 in the housing may also be provided proximate to substrate 88.

The thickness of ink conduit walls 162, 163 is about 0.5 mm, but thinner walls may also be used. The lower limit is dependent more on manufacturing tolerances than on thermal performance of the device. Walls thicker than 0.5 mm will also work. Thicker walls will have better thermal performance, but worse pressure drop and bubble tolerance.

Ink conduit walls 162, 163 then direct the flow of ink 92 along the back of substrate 88 through a narrow gap between the back of the substrate 88 and the ink conduit walls 162, 163. The narrow gap is much narrower than in prior print cartridge designs. Flow directors 165 then direct the ink flow 92 around the edge of substrate 88 into ink channels 132. As the fluid flows from the ink conduit 63 and impinges on the substrate 88, heat transfers from the substrate 88 into the ink as it flows toward the drop ejection chambers where the warm ink is ejected onto media. The fluid directors 165 reduce the warming of the ink in the bubble accumulation chamber and improve heat transfer between substrate 88 and the ink.

The ink conduit walls 162, 163 of the ink conduit 63 terminate approximately 0.127 mm (5 mils) from the back of the substrate 88, thereby forming the narrow gap. An acceptable range for this gap is from about 3 mils to about 12 mils, depending on the ink viscosity and flow rates.

Although the same volume of ink is ejected from nozzles 82 as in previous print cartridges, the ink velocity across the back of substrate 88 is much higher due to the narrow gap that exists between substrate 88 and ink conduit walls 162, 163 at the end of ink conduit 63 relative to the large area available for flow everywhere in ink conduit 63. The increased ink velocity caused by the proximity of ink conduit walls 162, 163 to the back of substrate 88 and the flow director 165 cause a relatively large transfer of heat from the back of substrate 88 to the moving ink. The heated ink flows around the edges of substrate 88 and into ink inlet channels 132 and then into the ink ejection chambers 94.

Inkjet printheads are very sensitive to particulate contamination. To deal with this problem, a filter is required between the reservoir of ink 61 and the printhead 83. The filter prevents particulate contaminates from flowing from the ink reservoir 61 to the printhead 83 and clogging the printhead nozzles 82.

Another problem that occurs during the life of the print element is air out-gassing. Air builds up between the filter 202 and the printhead 83 during operation of the printhead. Shown in FIG. 7 are bubble accumulation chambers 168, 170 defined and formed by the walls of filter carrier 200, ink conduit walls 162, 163 and the walls of cartridge body 110. As the ink heats up, the solubility of air in the ink decreases, and air defuses out of the ink in the form of bubbles 112. In order for these bubbles 112 to not restrict the flow of ink, bubble accumulation chambers 168, 170 are formed in the print cartridge body to accumulate these bubbles. Bubble accumulation chambers 168, 170 are defined and formed by the filter carrier 200 walls, the ink conduit walls 162, 163 and the walls of cartridge body 110 and the fluid director 165 of cartridge body 110. The bubble accumulation chambers 168, 170 are positioned above substrate 88 relative to a gravitational frame of reference when the printhead is mounted in the printing system. In the embodiment depicted by FIG. 7, two bubble accumulation chambers 168, 170 are formed on opposite sides of conduit 63. One chamber 168 is formed between wall 163 and an outer portion of the printhead housing 110. Another chamber 170 is formed between wall 162 and an outer portion of printhead housing 110.

A space between each laterally extending flow director 165 and the distal end of conduit 63 defines a bubble escape opening. The bubble escape opening communicates between the ink flow path and the bubble accumulation chamber. In the embodiment depicted, flow directors 165 define an angle or a converging geometry relative to the back surface of substrate 88. Hence, bubbles 112 will not interfere with the flow of ink 92 through ink conduit 63 and around the edges of substrate 88 into the inlet channels 132 and then into ink ejection chambers 94.

For printers that have an intended high use rate, it would be preferable to have a larger volume between the filter and the printhead for the storage of air. For low use rate printers, this volume could be reduced. The filter carrier 200 height can be adjusted to readily provide varying volumes for bubble accumulation chambers 168, 170 depending on the anticipated out-gassing. In the preferred embodiment, these bubble accumulation chambers 168, 170 each have a capacity of 2 to 3 cubic centimeters; however, the capacity can be greater than or less than this preferred volume depending on the anticipated out-gassing. An acceptable range is approximately 1 to 5 cubic centimeters. Bubble accumulation chambers 168, 170 extend along the length of substrate 88 to be in fluid communication with all the ink channels 132 formed in barrier layer 104 on substrate 88.

The mesh size of filter 202 is sufficiently small that while ink may pass through the passages of the mesh, air bubbles under normal atmospheric pressure will not pass through the mesh passages which are wetted by the ink. As a result, the mesh also serves the function of an air check valve for the print cartridge.

Ink passes from reservoir 61 through conduit 63 and out of the distal opening in conduit 63. In a preferred embodiment, the ink flow 92 is in a first direction substantially perpendicular to substrate 88. The ink flow exits the distal end of conduit 63 in this first direction, and then is redirected in a second direction substantially parallel to substrate 88. In the embodiment depicted in FIG. 7, the ink forms a bifurcated flow pattern, wherein substantially half of the ink passes in the second direction, and the remaining ink passes in a third direction that is substantially opposite to the second direction. In a preferred embodiment, the ink completes the direction change within a distance of approximately 3 to 12 mils. It along the surface of the substrate wherein the ink changes direction wherein most of the heat transfer takes place. Laterally extending portions 167 increase the heat transfer and direct the flow of ink in the second and third directions.

The laterally extending portions 167 work in cooperation with fluid directors 165 to channel the ink flow path 92 around substrate 88 to maximize heat transfer to the ejected in droplets. In other words, this geometry minimizes the amount of heat transferred from substrate 88 to the ink contained in the bubble accumulation chambers. The laterally extending portions provide a converging geometry for the ink flow path to better direct ink in the flow path.

However, bubble escape openings are provided to allow bubbles to escape from the ink flow path to the bubble accumulation chambers to prevent bubbles from occluding or substantially increasing flow resistance in the ink flow path.

Figure 8:
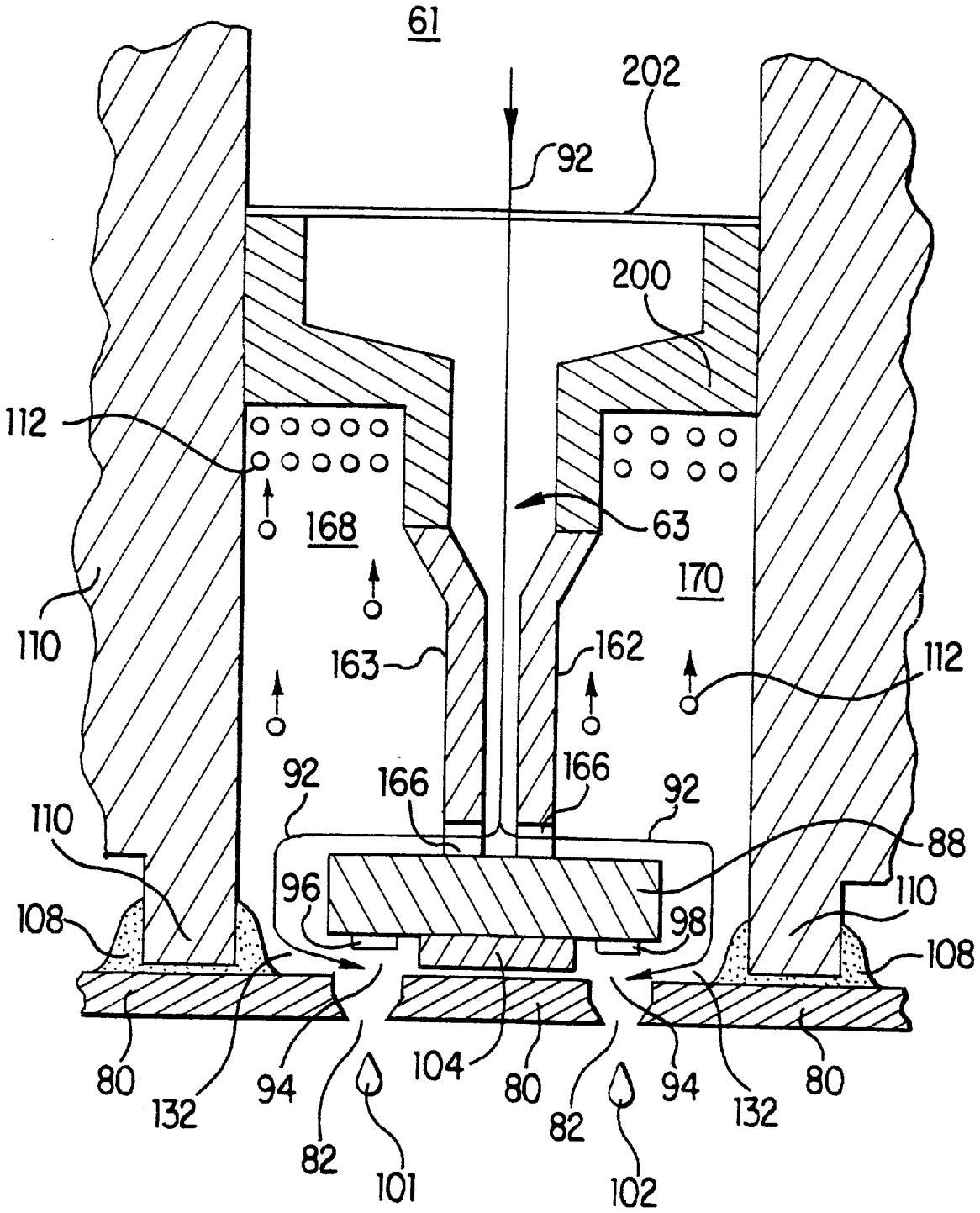
FIG. 8 is a cross-sectional view along line B—B of FIG. 2 showing the flow of ink to the ink ejection chambers in an edge feed printhead using an embodiment of the present invention.

FIG. 8 is a cross-sectional view along line B—B of FIG. 2 showing the flow of ink to the ink ejection chambers in an edge feed printhead using another embodiment of the present invention. In this embodiment ink conduit walls 162, 163 are in physical contact with the back side of the substrate 88. Ink channels or openings 166 are provided in the distal end of ink conduit walls 162, 163 to allow ink to flow through the ink channels 166 in the ink conduit walls 162, 163 and along the back side of substrate 88. By contacting the ink conduit walls 162, 163 against the substrate 88. the distance between the impinging column of fluid and the back of the substrate is minimized. This maximizes the cooling effect of the ink. The ink channels 166 in the ink conduit walls 162, 163 may be a single channel almost the length of the substrate with stand-off wall portions a each end of the substrate or individual ink channels distributed along the length of the substrate.

The inventive concepts described above for increasing the velocity of ink flowing across a substrate while avoiding the possibility of bubbles blocking the ink conduit may be applied to other types of printheads.

Figure 9:
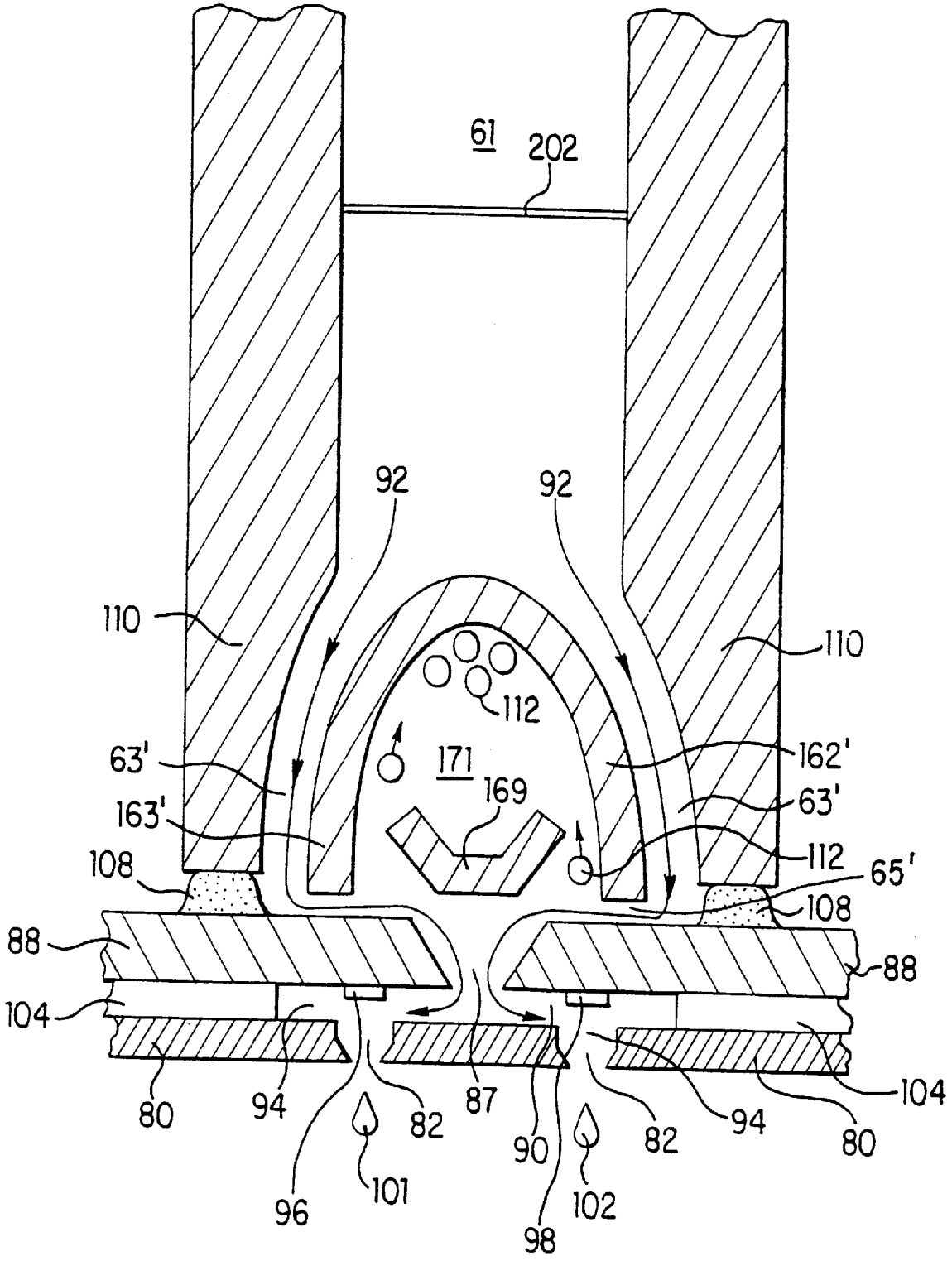
FIG. 9 is a cross-sectional view along line B—B of FIG. 2 showing the flow of ink to the ink ejection chambers in a center feed printhead using an embodiment of the present invention.

FIG. 9 is a cross-sectional view along line B—B of FIG. 2 showing a bifurcated flow of ink to the ink ejection chambers in a center feed printhead using another embodiment of the present invention. FIG. 9 shows a center feed printhead using impinging flow, wherein ink conduits 63' are formed by walls 162', 163' and the inner wall of cartridge body 110. Flow director 169 then directs the ink flow 92 toward the central ink slot 87 in substrate 88. The narrow gaps 65' formed between the back of the substrate 88 and walls 162', 163' and flow director 169 cause the ink 92 to run at relatively high velocity along a larger surface area of substrate 88. The increased ink velocity caused by the proximity of ink conduit walls 162', 163' to the back of substrate 88 and the flow director 167 cause a relatively large transfer of heat from the back of substrate 88 to the moving ink. While FIG. 9 shows a narrow gap between walls 162', 163' and substrate 88, it is readily apparent that ink conduit walls 162', 163' could be in contact with substrate 88 and have ink channels to allow ink to flow through the ink channels in the ink conduit walls 162, 163 and along the back side of substrate 88 as described with respect to FIG. 8. By contacting the ink conduit walls 162, 163 against the substrate 88, the distance between the impinging column of fluid and the back of the substrate is minimized. This maximizes the cooling effect of the ink. The ink channels 166 in the ink conduit walls 162, 163 may be a single channel almost the length of the substrate with stand-off wall portions a each end of the substrate or individual ink channels distributed along the length of the substrate.

A central bubble accumulation chamber 171 is shown which accumulates bubbles 112 which have out-diffused from the ink as the ink is heated by substrate 88. Bubble accumulation chamber 171 is positioned substantially above substrate 88 relative to a gravitational frame of reference to collect bubbles generated proximate to a back surface of substrate 88. A laterally extending flow director 169 is positioned above ink feed slot. A bubble escape opening are defined between flow director 169 and a distal end of conduit wall 162'. Bubbles that are generated in the ink flow path 92 escape through the bubble escape opening and to the bubble accumulation chamber. An opening is provided between the fluid director 169 and the ink conduit walls 162', 163' allow bubbles to escape into bubble accumulation chamber 169. Hence, bubbles 112 will not interfere with the flow of ink 92 through ink conduit 63' and into ink ejection chambers 94. The fluid director 169 also reduces the warming of the ink in the bubble accumulation chamber 171 and improves heat transfer between substrate 88 and the ink. The complete structure of the printhead illustrated in FIG. 9 would be readily understood by one skilled in the art.

The added heat withdrawn from the substrate due to the novel ink conduit 63' allows the printhead to operate at higher speeds without adversely affecting the print quality. The enhanced thermal performance does not rely on any attachments to the substrate, such as a heat exchanger. Such attachments would likely be much more complex and costly. The print cartridge may be a single-use disposable cartridge, a refillable cartridge, or a cartridge connected to an external ink supply.

Figure 10:
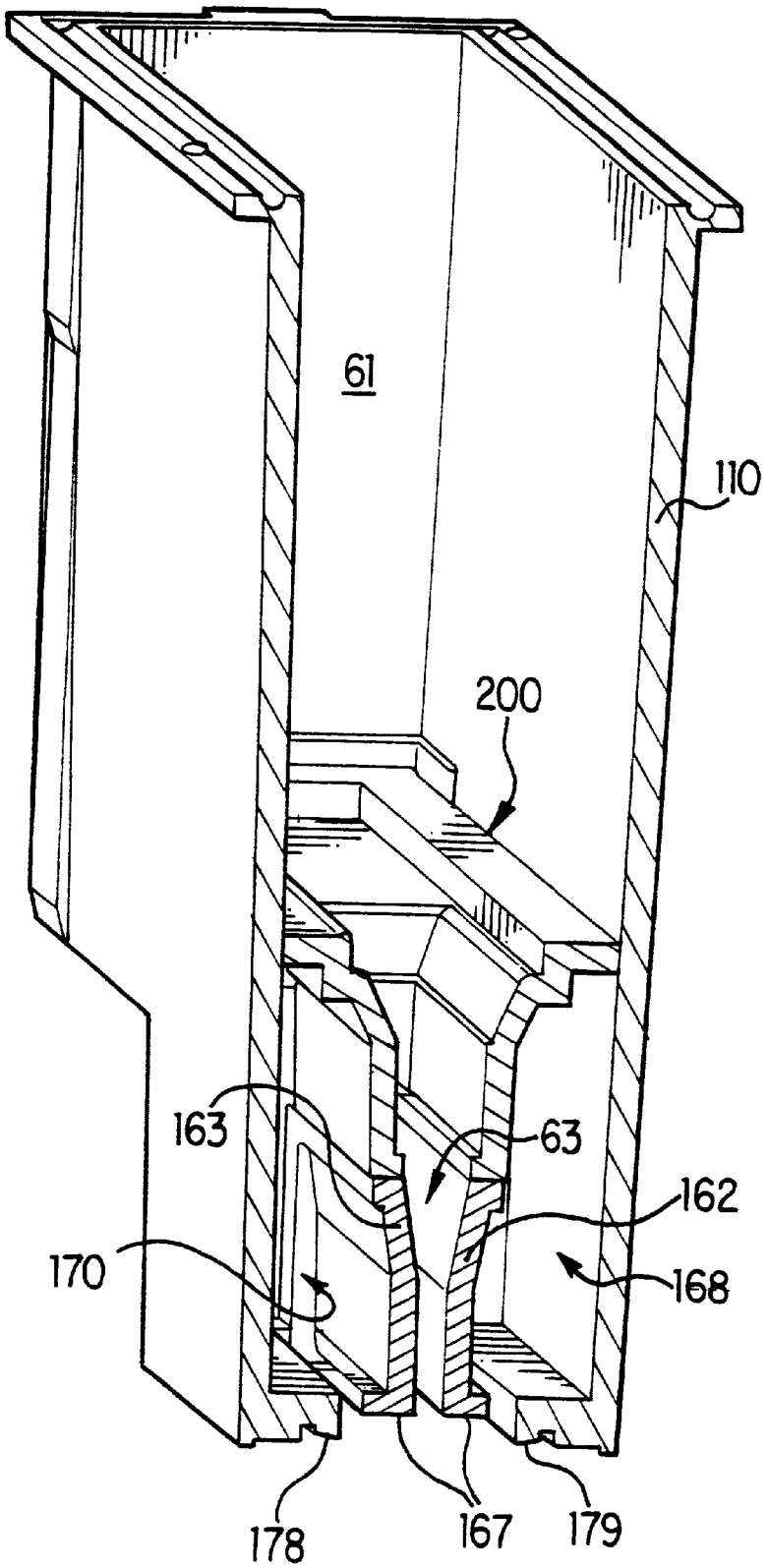
FIG. 10 is a cross-sectional, perspective view along line B—B of FIG. 2 illustrating an ink chamber for containing a pressure regulator, the filter carrier and the ink flow conduit leading to the back surface of the substrate.

FIG. 10 is a cross-sectional, perspective view of the print cartridge of FIG. 7 along line B—B of FIG. 2. with tape 80 removed. Shown is the ink chamber 61 for containing ink and a pressure regulator, the filter carrier 200 (with filter screen 202 removed) ink conduit walls 162 and 163, the ink conduit 63 (defined by the filter carrier 200 and walls 162, 163) leading to the back surface of the substrate 88 and bubble accumulation bubble accumulation chambers 168, 170 defined and formed by the filter carrier 200 and the ink conduit walls 162, 163 and cartridge body 110.

Figure 11:
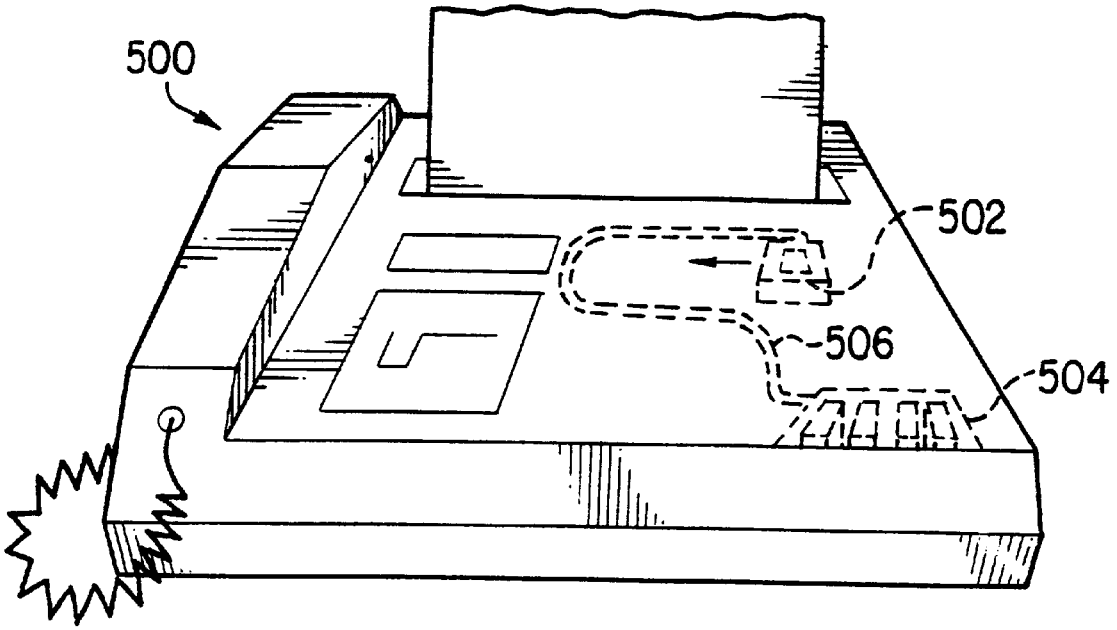
FIG. 11 is a perspective view of a facsimile machine showing one embodiment of the ink delivery system in phantom outline.

The present invention allows a wide range of product implementations other than that illustrated in FIG. 2. For example, such ink delivery systems may be incorporated into an inkjet printer used in a facsimile machine 500 as shown in FIG. 11 where a scanning cartridge 502 and an off-axis ink delivery system 504, connected via tube 506, are shown in phantom outline.

Figure 12:
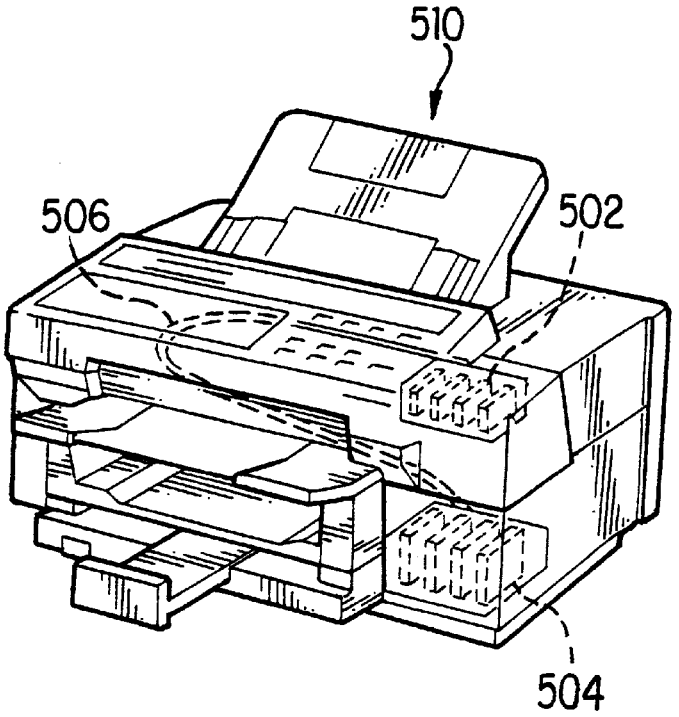
FIG. 12 is a perspective view of a copier, which may be a combined facsimile machine and printer, illustrating one embodiment of the ink delivery system in phantom outline.

FIG. 12 illustrates a copying machine 510, which may also be a combined facsimile/copying machine, incorporating an ink delivery system described herein. Scanning print cartridges 502 and an off-axis ink supply 504, connected via tube 506, are shown in phantom outline.

Figure 13:
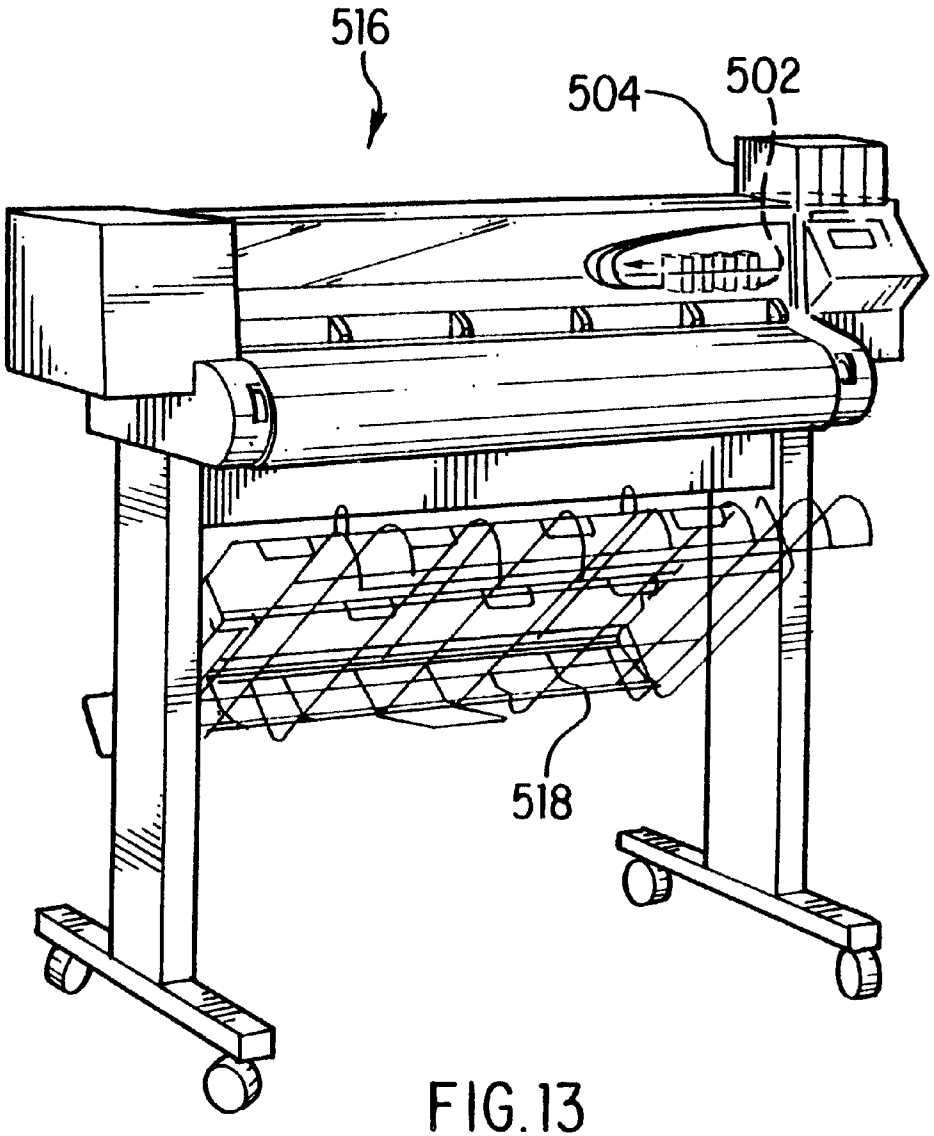
FIG. 13 is a perspective view of a large-format inkjet printer illustrating one embodiment of the ink delivery system.

FIG. 13 illustrates a large-format printer 516 which prints on a wide, continuous paper roll supported by tray 518. Scanning print cartridges 502 are shown connected to the off-axis ink supply 504 via tube 506.

While particular embodiments of the present invention have been shown and described, it will be obvious to those skilled in the art that changes and modifications may be made within departing from this invention in its broader aspects and, therefore, the appended claims are to encompass within their scope all such changes and modifications as fall within the true spirit and scope of this invention.

What is claimed is:

1. A printing device, comprising:

an outer housing;

a substrate having a front surface on which is formed ink ejection chambers and having a back surface;

an ink conduit having a distal end proximate to the back surface of the substrate, the ink conduit, the outer housing and the substrate defining an ink flow path through which substantially all the ink flows to the ink ejection chambers; and a bubble accumulation chamber in communication with the ink flow path such that buoyancy of bubbles that accumulate in the ink flow path moves the bubbles into the bubble accumulation chamber.

2. The printing device of claim 1, wherein channels are formed between distal end of the ink conduit and the back of the substrate to allow ink to flow to the ink ejection chambers.

3. The printing device of claim 1, wherein the distal end of the ink conduit abuts against the back surface of the substrate and wherein openings are formed in distal end of the ink conduit to allow ink to flow along the back surface of the substrate to the ink ejection chambers.

4. The printing device of claim 1, further including at least one laterally extending wall at the distal end of the ink conduit that extends substantially parallel to the back surface of the substrate along a portion of the back surface of the substrate to further define an ink flow path along the back of the substrate to the ink ejection chambers.

5. The printing device of claim 1, further including a flow director laterally extending from the housing toward the ink conduit to further define an ink flow path along the back of the substrate to the ink ejection chambers.

6. The printing device of claim 1, further including a flow director laterally extending from the housing toward the ink conduit, the flow director and the ink conduit having a gap therebetween that defines a bubble escape window to provide an escape path for bubbles formed in the ink flow path.

7. The printing device of claim 1, further including a scanning carriage in which the housing is mounted.

8. The printing device of claim 1, further including a supply of ink to the ink conduit.

9. A printing device, comprising:

an outer housing;

a substrate having a front surface on which is formed ink ejection chambers and having a back surface;

an ink conduit defined by the outer housing and the substrate so as to provide an ink flow path through which substantially all the ink flows, the ink flow path is directed in a first direction substantially perpendicular to the substrate until it is proximate to the back surface of the substrate, the ink flow path then bends at approximately a right angle and flows substantially parallel to the substrate, the ink flow path then extends around an edge of the substrate and then into the ink ejection chambers, wherein the ink convectively removes heat from the substrate; and a bubble accumulation chamber in communication with the ink flow path such that buoyancy of bubbles that accumulate in the ink flow path moves the bubbles into the bubble accumulation chamber.

10. The printing device of claim 9, wherein the distal end of the ink conduit abuts against the back surface of the substrate and wherein openings are formed in distal end of the ink conduit to allow ink to flow along the back surface of the substrate to the ink ejection chambers.

11. The printing device of claim 9, further including at least one laterally extending wall at the distal end of the ink conduit that extends substantially parallel to the back surface of the substrate along a portion of the back surface of the substrate to further define an ink flow path along the back of the substrate to the ink ejection chambers.

12. The printing device of claim 9, further including a flow director laterally extending from the housing toward the ink conduit to further define an ink flow path along the back of the substrate to the ink ejection chambers.

13. The printing device of claim 9, further including a flow director laterally extending from the housing toward the ink conduit, the flow director and the ink conduit having a gap therebetween that defines a bubble escape window to provide an escape path for bubbles formed in the ink flow path.

14. The printing device of claim 9, further including a scanning carriage in which the housing is mounted and a media advance mechanism.

15. The printing device of claim 9, further including a supply of ink to the ink conduit.

16. A printing device, comprising:

a substrate having a front surface on which is formed ink ejection chambers and having a back surface;

an ink conduit having a distal end that terminates less than 20 mils from the back surface of the substrate so that substantially all of the ink flows through the ink conduit, across a portion of the substrate, and into the ink ejection chambers; and at least one bubble accumulation chamber in communication with the ink flow path for accumulating bubbles.

17. The printing device of claim 16, wherein the distal end of the ink conduit abuts against the back surface of the substrate and wherein openings are formed in distal end of the ink conduit to allow ink to flow along the back surface of the substrate to the ink ejection chambers.

18. The printing device of claim 16, further including at least one laterally extending wall at the distal end of the ink conduit that extends substantially parallel to the back surface of the substrate along a portion of the back surface of the substrate to further define an ink flow path along the back of the substrate to the ink ejection chambers.

19. The printing device of claim 16, further including a flow director laterally extending from the housing toward the ink conduit to further define an ink flow path along the back of the substrate to the ink ejection chambers.

20. The printing device of claim 16, further including a flow director laterally extending from the housing toward the ink conduit, the flow director and the ink conduit having a gap therebetween that defines a bubble escape window to provide an escape path for bubbles formed in the ink flow path.

21. The printing device of claim 16, further including a scanning carriage in which the housing is mounted and a media advance mechanism.

22. The printing device of claim 16, further including a supply of ink to the ink conduit.

23. An ink delivery device comprising:

an inkjet printhead including a substrate having a front side and having a back side, the front side having ink ejection chambers formed thereon, the printhead including a fluid ink conduit having a distal end that terminates proximate to the back surface of the substrate, the printhead including a bubble accumulation chamber for accumulating bubbles generated proximate to the back surface of the substrate;

a fluid reservoir adapted to be releasably mounted to a printing system;

a fluid outlet in fluid communication with the fluid reservoir; and ink contained within the fluid reservoir that passes out of the fluid outlet, to the ink conduit, out of the distal end of the ink conduit, and to the ink ejection chambers when the fluid reservoir is releasably mounted to the printing system.

24. An ink delivery device for providing ink to an inkjet printhead, the printhead coupled to a fluid inlet, the ink delivery device including:

a fluid outlet;

a fluid reservoir in fluid communication with the fluid outlet, the fluid reservoir couples with the printhead to form an ink delivery system when the fluid outlet is fluidically coupled to the fluid inlet, the ink delivery system including a substrate having a front surface on which ink ejection chambers are formed and a back surface, an ink conduit having a distal end proximate to the back surface of the substrate, so that substantially all of the ink flows through the ink conduit and across a portion of the back surface of the substrate and into the ink ejection chambers; and a bubble accumulation chamber in communication with the ink flow path such that buoyancy of bubbles that accumulate in the ink flow path moves the bubbles into the bubble accumulation chamber.

* * * * *

UNITED STATES PATENT AND TRADEMARK OFFICE

CERTIFICATE OF CORRECTION

PATENT NO. : 6,120,139
DATED : September 19, 2000
INVENTOR(S) : Childers et al.

It is certified that error appears in the above-identified patent and that said Letters Patent is hereby corrected as shown below:

In the References Cited section of the title page, please add the following references:

| | | | |
|---|---|---|---|
| 5,632,292 | 4/1997 | Shrivastava | 347/18 |
| 5,459,498 | 10/1995 | Seccombe | 347/18 |
| 5,121,130 | 6/1992 | Hempel | 347/18 |
| 5,084,713 | 1/1992 | Wong | 347/18 |
| 5,017,941 | 5/1991 | Drake | 347/67 |

Signed and Sealed this

Nineteenth Day of June, 2001

*Attest:*

Nicholas P. Godici

*Attesting Officer*

NICHOLAS P. GODICI
*Acting Director of the United States Patent and Trademark Office*